United States Patent [19]

Del Bagno et al.

[11] Patent Number: 4,489,777

[45] Date of Patent: Dec. 25, 1984

[54] HEAT PIPE HAVING MULTIPLE INTEGRAL WICK STRUCTURES

[76] Inventors: Anthony C. Del Bagno; Richard R. Giordano; Frederick Rose, all of 12 Cedar St., Newton, N.J. 07860

[21] Appl. No.: 341,360

[22] Filed: Jan. 21, 1982

[51] Int. Cl.[3] ..... F28D 15/00

[52] U.S. Cl. ..... 165/104.26; 165/133

[58] Field of Search ..... 165/104.26, 133

[56] References Cited

U.S. PATENT DOCUMENTS

| | | | |
|---|---|---|---|
| 3,537,514 | 11/1970 | Levedahl | 165/104.26 |
| 3,734,173 | 5/1973 | Moritz | 165/104.26 |
| 3,865,184 | 2/1975 | Grover | 165/104.26 |
| 4,020,898 | 5/1977 | Grover | 165/104.26 |
| 4,058,159 | 11/1977 | Iriarte | 165/104.26 |
| 4,109,709 | 8/1978 | Honda et al. . | |
| 4,116,266 | 9/1978 | Swata et al. | 165/104.26 X |
| 4,186,796 | 2/1980 | Usui . | |
| 4,274,479 | 6/1981 | Eastman . | |

FOREIGN PATENT DOCUMENTS

| | | | |
|---|---|---|---|
| 46331 | 4/1980 | Japan | 165/104.26 |

*Primary Examiner*—Albert W. Davis, Jr.
*Attorney, Agent, or Firm*—Henderson & Sturm

[57] ABSTRACT

This invention relates generally to the field of heat pipes, and is specifically concerned with an internal wicking structure to promote the capillary flow of a system liquid from the condensor section to the evaporator section, such that the evaporator section is uniformly saturated. This phenomena is achieved through the use of multiple diverse wicking patterns, formed integrally in the interior walls of the heat pipe.

4 Claims, 10 Drawing Figures

HEAT PIPE HAVING MULTIPLE INTEGRAL WICK STRUCTURES

BACKGROUND OF THE INVENTION

In general, heat pipes, and the concepts which surround their use, are well recognized by the prior art. A heat pipe is a closed, constant mass heating system in which the system liquid coexists in equilibrium with its vapor during normal operating temperatures. It consists of an evaporator section, in which the system liquid is heated and vaporized; an adiabatic section, in which both vapor and condensed liquid flow with no heat being externally transferred; and a condensor section, in which the latent heat of vaporization is transferred to the external surroundings, and the condensed liquid flows via capillary action back towards the evaporator. The axial flow of the vapor and the capillary flow of the returning system liquid are both produced by pressure gradients, that are created by the interaction between naturally-occurring pressure differentials within the heat pipe. These pressure gradients eliminate the need for external pumping of the system liquid. In addition, the existence of liquid and vapor in equilibrium, under vacuum conditions, results in higher thermal efficiencies.

Heat pipes, as mentioned above rely for their operation upon the existence of the induced pressure gradients, which work to force vapor flow toward the condenser, and capillary liquid flow back toward the evaporator.

In order to increase the efficiency of heat pipes, various wicking structures have been developed to promote liquid transfer between the condensor and evaporator sections. They have included longitudially disposed parallel grooves and the random scoring of the internal pipe surface. In addition, the prior art also discloses the use of a wick structure which is fixidly attached to the internal pipe wall. The compositions and geometries of these wicks have included, a uniform fine wire mesh, and circumferentially disposed fine wire hoops of varied spacing.

All of the geometries, either integral to the internal pipe wall or integral to the affixed wick, are chiefly designed to promote liquid and vapor flow while maintaining high thermal efficiencies through the pipe wall to the ambient surroundings.

In general, the wick structures disclosed in the prior art provide grooves for condensate return to the evaporator, such that evaporator "dryout" is minimized. However, these internal structures fail to accomodate the different requirements and functions of each particular section of the heat pipe, and therefore they do not produce the optimum output available from structures of this type.

Examples of some of the aforementioned prior art devices may be seen by reference to U.S. Pat. Nos. 4,109,709; 4,116,266; 4,058,159; 4,274,479; and 4,186,796.

These prior art devices, while adequate for their intended purpose, suffer from the common deficiency, in that they do not fully realize the optimum inherent heat transfer potential available from a given heat pipe.

To date, no one has devised a wick structure for a heat pipe, which is simple to produce, and yet provides optimum heat transfer characteristics for the heat pipe in which it is utilized.

SUMMARY OF THE INVENTION

An object of this invention is the provision of an improved heat pipe internal wicking structure which promotes liquid transfer from the evaporator section to the condensor section and vice versa.

Another object of the present invention is the provision of an improved heat pipe having a wicking structure which is both integral and diverse.

A further object of the present invention is the provision of an improved heat pipe, wherein integral and diverse wicking structures are formed in the interior walls by knurling. Broaching, thread rolling, cutting, extruded and cold forming can also be used.

A still further object of the present invention is the provision of an improved heat pipe, wherein the process used to form an integral and diverse wicking structure, increases the internal surface area of the heat pipe.

Yet another object of the present invention is the provision of an improved heat pipe structure, which optimizes the inherent heat transfer available from the heat pipe.

A yet further object of the present invention is the provision of an improved heat pipe structure, which will insure that the evaporator section remains saturated, thereby eliminating evaporator "dryout", which causes "hot spots" on the heat pipe surface.

Another object of the present invention is the ability to select the optimum wick structure for the heat pipe. This optimum wick structure is achieved by matching wick and liquid characteristic requirements for each section of each heat pipe.

These and other objects, advantages, and novel features of the invention will become apparent from the detailed description which follows when considered in conjunction with the accompanying drawings.

DETAILED DESCRIPTION OF THE PREFERRED EMBODIMENT

Figure 1:
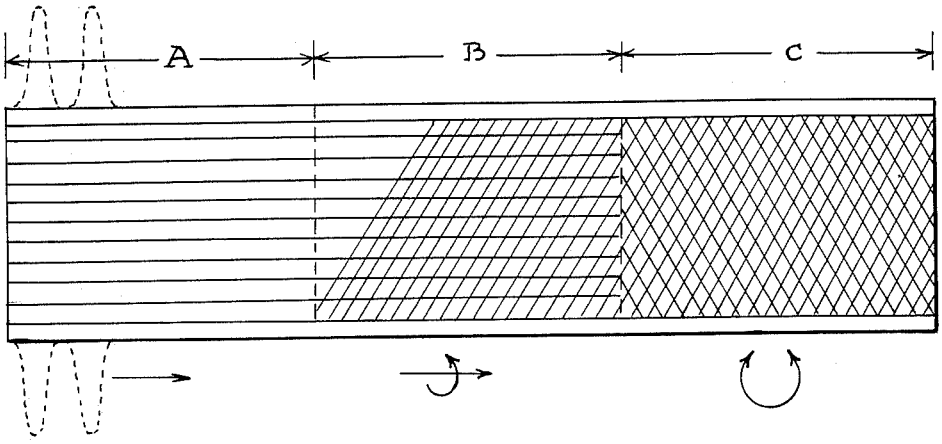
FIG. 1 is a cross sectional view of one form of the preferred embodiment for the improved heat pipe, which is to be used in unidirectional applications.

As can be seen by reference to FIG. 1, the improved heat pipe, which forms the basis for this invention is designated generally as 10, and comprises a tubular element 11 having a plurality of fins, or external projections 12 disposed on its exterior wall, in a well recognized fashion.

The heart of this invention, however, resides in the revolutionary integral and diverse wicking structures 50, which have been formed in the internal walls of the tubular element 11.

Since every heat pipe 10 is divided into three distinct sections, these sections have been labeled A thru C, and represent the condensor, adiabatic and evaporator sections respectively. As will be explained below, each of these sections performs their own unique function.

A heat pipe 10, basically consists of three elements; a sealed container formed by closing the ends of the tubular element 11; a capillary wick structure 50, integral to the interior surface of the container; and sufficient working fluid 100, to saturate the wick structure.

Because the container is sealed under vacuum, the working fluid, is in equilibrium with its own vapor. Heating any part of the external surface causes the instantaneous evaporation of the working fluid near the surface, which becomes an evaporator region C, and the latent heat of vaporization is absorbed by the vapor formed.

The rapid generation of vapor at any point on the tube wall area creates a pressure gradient within the heat pipe, which forces the excess vapor to a remote area of the heat pipe having lower pressure and temperature, where it condenses on the tube wall and the latent heat of vaporization is released.

Heat is removed from the surface at the point of condensation by conduction, convection or radiation. A continuous process is established by the capillary pumping forces within the wick structure that returns the fluid from the condenser region A (point of heat removal) to the evaporator region C (point of heat addition). Each heat pipe theoretically has a thermal efficiency approaching 99%.

Figure 3:
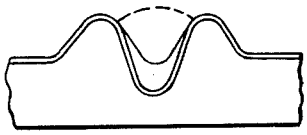

The evaporation-condensation heat transfer process causes liquid to be depleted in the evaporator section C and accumulated in the condensor section A, which must be equalized by the surface-tension pumping of the liquid in the wicking structure 50. In order for the wicking structure to function properly it is necessary for the liquid to wet the surfaces of the integral wick structure of the evaporator section C. Proper wetting occurs when the liquid is drawn into, and saturates the integral wick structure by the surface-tension forces of the liquid. The surface tension forces exist along the free surface interface, between the liquid in the integral saturated wick, and the adjacent vapor space. As heating causes liquid to be depleted from the evaporator section C and the local vapor pressure to increase, the free surface interface becomes depressed (see FIG. 3), into the integral wick structure of the evaporator.

Figure 2:
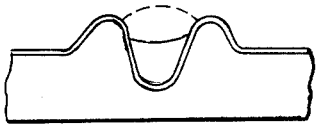
FIGS. 2 and 3 are detailed views of the capillary wick structures formed in the condensor and evaporator sections respectively.

In the condensor section A, the accumulation of liquid and lower vapor pressure causes the free surface interface to become nearly flat (see FIG. 2).

The difference in the shape of the free surface interface and the integral wick design between the evaporator and the condensor section creates, a pressure gradient in the liquid. This pressure gradient is sustained by the different surface tension forces, and the diverse integral wick configurations of the respective sections.

Referring back to FIG. 1, it can be seen that the condensor section A is provided with a plurality of axial grooves 61, which form the condensor section wicking structure 60. These axial grooves or channels 61 can be formed by any suitable means such as extrusion, broaching, cutting, cold forming, knurling, rolling, etc. It should be noted at this point; however, that knurling is the preferred method of forming all of the wicking structures described in the specification, for reasons which are set forth in our co-pending patent application Ser. No. 357,102 filed 3/11/82.

For the purpose of this disclosure, it should also be understood that axial grooves or channels are defined as grooves or channels, with or without a spiral, that are parallel to each other, and extend along the centerline of the pipe.

Since different working fluids 100, have different flow characteristics, the dimensions of the axial grooves or channels 61, will be selected to produce a low liquid flow resistance to the return of the condensed vapor, to the evaporation section C of the heat pipe from the condensor section A. The existence of these grooves or channels 61, further increases the surface area integral to the heat pipe wall in the condensor section, and thereby improves the thermal efficiency in that section.

In the preferred embodiment illustrated in FIG. 1, the evaporator section C, obviously has entirely different operating parameters than the condensor section A, since this particular heat pipe is used in unidirectional applications. In order to increase the efficiency of this section, it is desirable to increase the surface area integral with the wall, where the fluid can be evaporated into the vapor phase. While this increase in surface area in the condensor section had been accomplished by the use of axial grooves 61, the evaporator section requires that the fluid be distributed circumferentially, to expose the maximum fluid surface area, to the elevated temperatures in this region.

The evaporator section C is therefore provided with a plurality of circumferential grooves 81, which form the evaporator wicking structure 80. These circumferential grooves 81 can assume various alignments with respect to the centerline of the heat pipe, as long as they are parallel, and have a vertical orientation.

As can be seen by reference to FIGS. 1 and 4 thru 7, the circumferential grooves 81 can be arranged in a variety of ways (i.e. perpendicular to the centerline of the pipe, angled to the left or to the right, or a combination thereof). The primary criteria for the circumferential grooves, are that they aid in the lifting of heat pipe fluid by way of surface tension forces, thereby improving the internal surface wetting of the evaporator section wall, around its circumference. An added benefit obtained by the circumferential grooves is the increase in internal surface area integral to the wall, which improves the evaporator section performance for obvious reasons.

These circumferential grooves can be formed by any suitable means such as cutting, cold forming, knurling, rolling, etc. It should be noted at this point; however, that knurling is the preferred method of forming all of the wicking structures described in the specification, for reasons which are set forth in our copending patent application Ser. No. 357,102 filed 3/11/82.

The adiabatic section B functions as a transition zone or interface between the evaporator section C and condensor section A, and it is in this section B, that theoretically no heat transfer is taking place. However, as a practical matter, it is almost impossible to pinpoint the exact location of the adiabatic zone, for a given heat pipe, using various working fluids, and under different operating conditions. The only thing that is certain about its location, is that it is somewhere between the condensor section end, and the evaporator section end.

Figure 4:
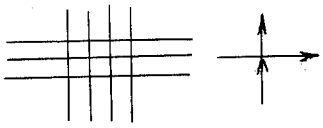
FIGS. 4 thru 6 are variations of the capillary wick pattern, used for the adiabatic section, showing various working fluid flow paths.
Figure 5:
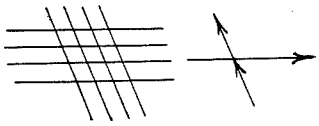
Figure 6:
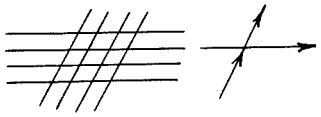

Given this situation, the adiabatic section should have an adiabatic wicking structure 90, which combines features found, in both the condenser, and the evaporator sections. The adiabatic wicking structure 90, therefore comprises a combination of axial grooves or channels 61, and circumferential grooves or channels 81. Examples of proposed wicking structures 90, for the adiabatic section are illustrated in FIGS. 4 thru 6.

The operation of this improved heat pipe containing the multiple and diverse wicking structures proceeds as follows: The working fluid (liquid and vapor phases) fills the interior of the heat pipe. As heat is applied to the evaporator section C, the liquid which has been drawn up into the circumferential grooves or channels, via capillary pumping and wick wetting action, is exposed to the heat over a much greater surface area, due to the presence of the integral wicking structure. As the working liquid evaporates, it allows returning condensed liquid to take the place of the evaporated liquid, via capillary pumping action, to keep the evaporator section saturated. The heated vapor then migrates to the cooler, lower pressure, condensor section, due to the pressure differential created with the heat pipe, by the application of heat to the evaporator section. The heated vapor will then condense on the enlarged surface area created by the axial channels and grooves. The condensed liquid will then be collected in the axial channels and fed by capillary and/or gravitational action back to the evaporator section.

Figure 7:
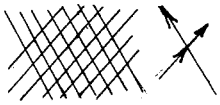
FIG. 7 shows the capillary wick pattern for the evaporator section of FIG. 1, and illustrates the working fluid flow path.

The direction of capillary flow through the condensor, adiabatic, and evaporator sections of the preferred embodiment are indicated by the arrows shown in FIG. 1, and are axial, axial-circumferential, and circumferential respectively. FIGS. 4 thru 6, illustrated different capillary flow patterns available in the adiabatic section, by varying the arrangement of the circumferential grooves or channels; and FIG. 7, illustrates in detain the preferred flow pattern through the evaporator section.

Figure 8:
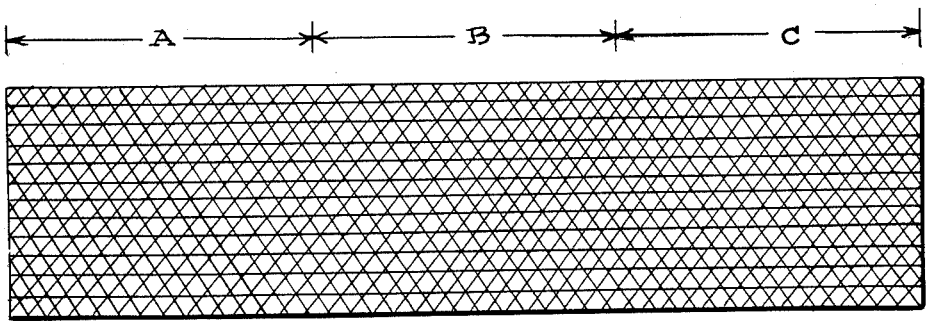
FIG. 8 is a modified version of the improved heat pipe whose wick structure allows this particular heat pipe to be used in bidirectional applications.

As mentioned supra, the heat pipe illustrated in FIG. 1, is used for uni-directional applications. The heat pipe shown in FIG. 8; however, can be used in bi-directional applications by combining all of the diverse, integral, capillary wicking structures throughout the heat pipe interior. It should by appreciated, that not only does this arrangement substantially increase the internal surface area integral with the heat pipe wall, but also allows axial flow in the axial grooves or channels, in either direction with respect to the heat pipe axis, depending on whether the heat pipe is being used for heating, cooling, or other bi-directional applications (i.e. process applications may require bidirectional use such as pollution control, condensing, etc.).

It should be noted at this point, that a good condenser wick geometry is one which has: a low pressure drop of returning condensate; no temperature gradient between wick and wall; a high condensing surface area to absorb latent heat of vaporation; compatability with the container and the liquid; high capillary pumping forces; the ability to return the condensed liquid uniformly for maximum condensate return; the ability to reduce evaporator wick dryout; the ability to reduce vapor/liquid shear; the ability to compliment different liquid characteristics; the ability to compliment the evaporator and adiabatic wick geometries; a smooth surface to reduce wetting and pressure drop; the ability to provide flow paths for condensate return; and the ability to match the operating temperature and heat flux.

A good evaporator wick geometry is one which has: a small pore radii; no temperature gradient between wick and wall; a high evaporating surface area to increase latent heat of vaporization; compatibility with container and liquid; the ability to provide maximum wetting; the ability to distribute the liquid uniformly throughout the evaporator for maximum operation in evaporating the liquid; the ability to compliment different liquid characteristics; the ability to lift the liquid; the ability to compliment the adiabatic and condenser wick geometries, no nucleate boiling within its structure; and the ability to match the operating temperatures and heat flux.

A good adiabatic wick geometry is one which has: the ability to provide a separation between the vapor/-liquid interface where the vapor/liquid shear is at its highest concentration; a transistion between condensor and evaporator wick geometries; the ability to provide a path for the condensate return; a low pressure drop of returning condensate; compatibility with the container and the liquid; and the ability to compliment different liquid characteristics.

The reason that different wick structures are needed can be summarized as follows:

The pore radii of the evaporator wick must be smaller than the pore radii of the condensor wick, to increase available surfact tension pumping forces. The pore radii of the evaporator which must be smaller than the pore radii of the condensor wick to improve wetting, by reducing meniscus radius in the evaporator region, while the larger pore radii in the condensor wick reduces wetting by increasing meniscus radius in the condensor region. The surface area, in the evaporator wick must be greater than the surface area in the condensor wick, due to the difference of the vapor state in the condensor as opposed to the liquid state in the evaporator. Vapor is more easily distributed in the condensor than liquid is distributed in the evaporator. The evaporator wick geometry characteristics, must be different than the condensor wick characteristics, due to the lifting requirements in the evaporator wick as opposed to the axial transport requirements in the condensor wick. Lifting requirements in the evaporator are to provide maximum wetting and evaporation. Axial transport requirements in the condensor are to provide maximum condensate return.

Evaporator wick geometries compliment condensor wick geometries because of the ability to select specific, but different evaporator and condensor wick designs, within a single heat pipe. Specific design requirements of the evaporator and condensor sections must match the specific operating temperatures and heat fluxs. Therefore, different wick designs in the evaporator and condensor sections can be selected. The axial transport characteristics of the condensor requires minimum liquid pressure drop of returning condensate over a longer distance; whereas, the lifting characteristics of the evaporator wick requires an insignificant pressure drop over a shorter distance. Finally, the vapor/liquid shear conditions are different in each section of the heat pipe. Thus requiring multiple and different wick geometries for each.

Figure 9:
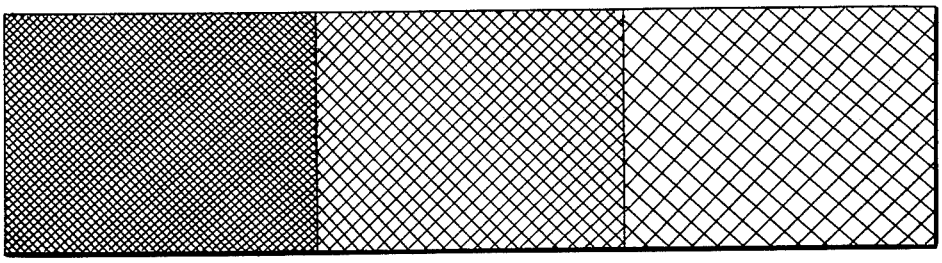
FIGS. 9 and 10 illustrate axial and circumferential wicking structures having the same geometries but different dimensions.
Figure 10:
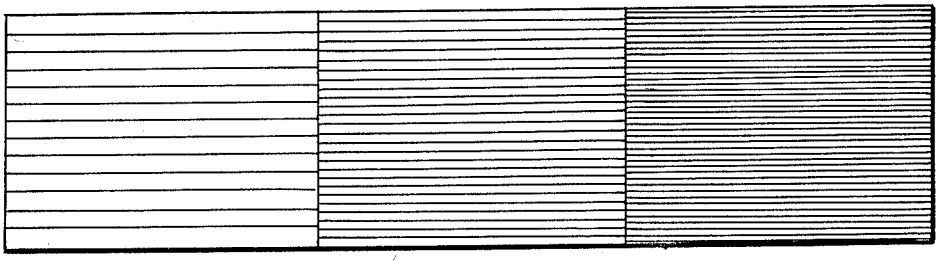

As can be seen by reference to FIGS. 9 and 10, not only does this invention contemplate different axial and circumferential wick geometries, but it also envisions wicking structures having the same geometries, but different dimensions for the individual groups of parallel grooves.

Having thereby disclosed the subject matter of this invention, it would be obvious that many substitutions, variations and modifications are possible in light of the above teachings. It is therefore to be understood that the invention as taught and disclosed is only to be limited by the breadth and scope of the appended claims.

What we claim:

1. An improved internal heat pipe construction for a heat pipe containing a heat transfer liquid and having a condensor section, an adiabatic section and an evaporator section, wherein the improvement comprises:

diverse capillary wicking patterns formed integrally with the interior walls by cutting the wall surface of the condensor, adiabatic and evaporator sections respectively, wherein one of said diverse wicking patterns comprises a plurality of parallel axial grooves, and another of said diverse wicking patterns comprises a plurality of angled parallel circumferential grooves; wherein the capillary grooves serve as the sole means for moving the liquid phase of said heat transfer liquid through said heat pipe, and the circumferential grooves are disposed at an angle other than 90° to the axial grooves for the purpose of feeding the heat transfer liquid between said sections.

2. An improved internal heat pipe construction as in claim 1; wherein, the circumferential grooves are disposed at an angle other than 90° to the axis of the heat pipe.

3. An improved internal heat pipe construction as in claim 1; wherein, both of said diverse capillary wicking patterns only extend along a portion of the length of the heat pipe.

4. An improved internal heat pipe construction as in claim 1; wherein, both of said diverse capillary wicking patterns extend along the entire length of the heat pipe.

* * * * *